US005134814A

United States Patent [19]

Hauser

[11] Patent Number: 5,134,814

[45] Date of Patent: Aug. 4, 1992

[54] PREFABRICATED WINDOW STOOL/APRON UNIT

[75] Inventor: Richard F. Hauser, Clemmons, N.C.

[73] Assignee: Trim, Inc., Mocksville, N.C.

[21] Appl. No.: 671,202

[22] Filed: Mar. 18, 1991

[51] Int. Cl.[5] ..... E06B 3/00

[52] U.S. Cl. ..... 52/36; 52/211; 52/212; 52/213; 52/217; 52/208; 52/204

[58] Field of Search ..... 52/212, 213, 217, 208, 52/211, 204, 36

[56] References Cited

U.S. PATENT DOCUMENTS 1,034,601 8/1912 Ellis ..... 52/211

1,965,165 7/1934 Wilson ..... 52/213

*Primary Examiner*—David A. Scherbel

*Assistant Examiner*—Wynn Wood

*Attorney, Agent, or Firm*—Nixon & Vanderhye

[57] ABSTRACT

A prefabricated window stool/apron unit (10) comprises a ledge member (12) and a skirt member (14). The ledge member (12) has an essentially flat top horizontal surface (16) and an essentially flat back vertical surface (18). The skirt member (14) has an essentially flat vertical back surface (20). The skirt member (14) is positioned beneath the ledge member (12) whereby the back surfaces (18,20) of the ledge member (12) and skirt member (14) are essentially flush with one another to form a flat abutment surface (22). The skirt member (14) is oriented to receive fasteners (24) which extend orthogonally with respect to the abutment surface (22). A vertical front surface (30) of the ledge member (12) and a vertical front surface (32) of the skirt member (14) are contoured.

4 Claims, 3 Drawing Sheets

PREFABRICATED WINDOW STOOL/APRON UNIT

BACKGROUND

1. Field of Invention

This invention pertains to the enhancement of window trim, and particularly to a prefabricated window stool/apron unit.

2. Prior Art and Other Considerations

Window sills contribute both aesthetically and functionally to enhance a window. However, many window units commercially available do not include an integral stool or apron for use with a window sill.

Accordingly, it is an object of the present invention to provide an easily installed prefabricated window stool/apron unit.

An advantage of the present invention is the provision of a prefabricated window stool/apron unit which can be attached to either a window or to wallboard beneath a window.

SUMMARY

A prefabricated window stool/apron unit comprises a ledge member (i.e., a stool) and a skirt member (i.e., a apron). The ledge member has an essentially flat top horizontal surface and an essentially flat back vertical surface. The skirt member has an essentially flat vertical back surface. The skirt member is positioned beneath the ledge member whereby the back surfaces of the ledge member and skirt member are essentially flush with one another to form an abutment surface. The skirt member is oriented to receive fasteners which extend orthogonally with respect to the abutment surface. A vertical front surface of the ledge member and a vertical front surface of the skirt member are contoured.

The prefabricated window stool/apron unit which can be attached to either a window casement or to wallboard beneath a window.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
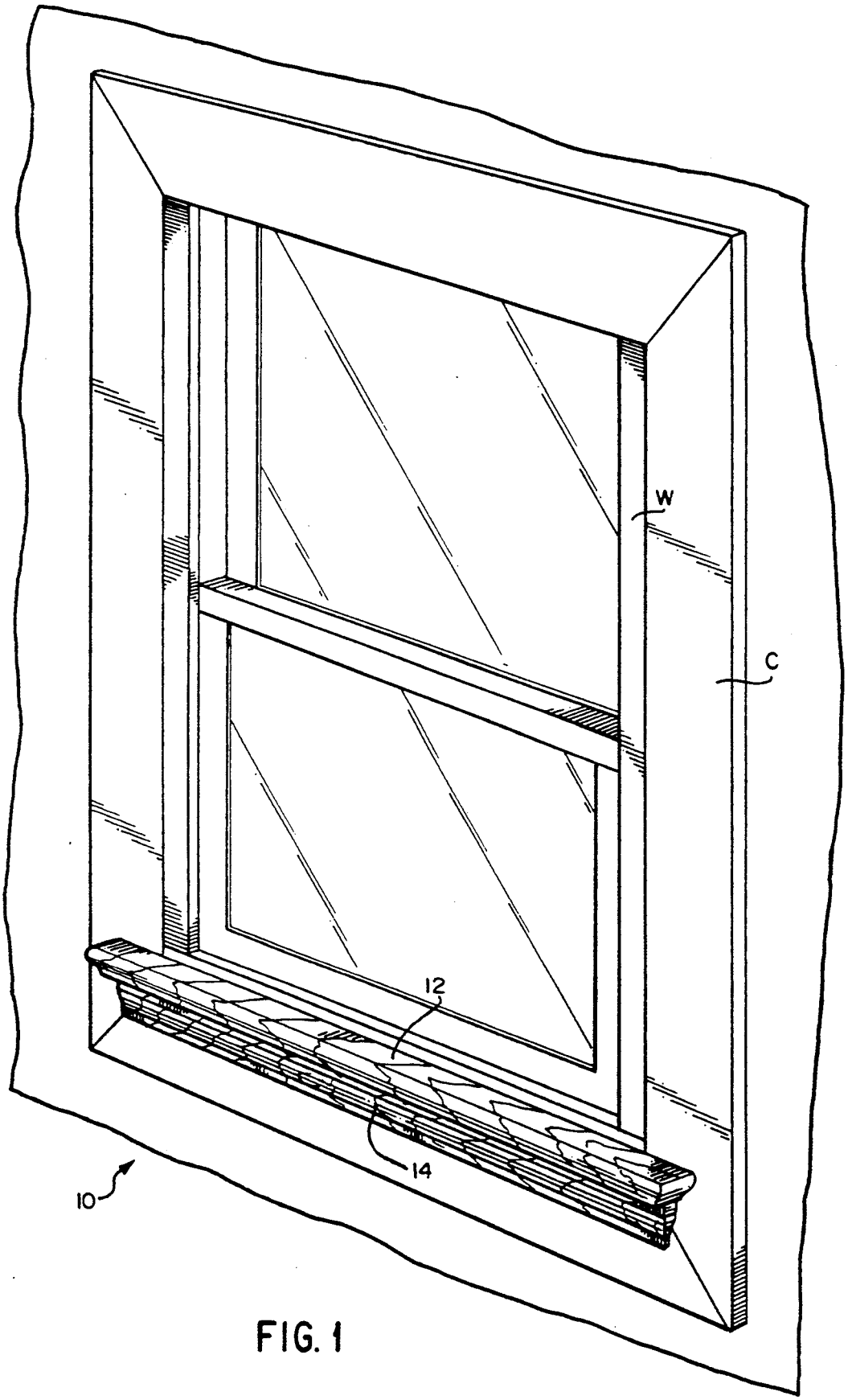
FIG. 1 is an isometric front view of a prefabricated window stool/apron unit according to an embodiment of the invention and further showing the manner of installation thereof to a window.
Figure 3:
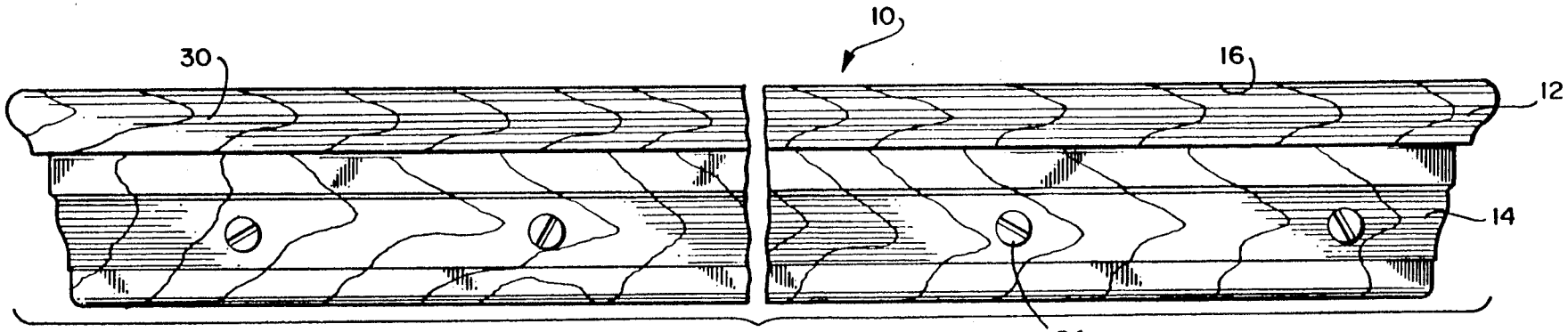
FIG. 3 is front view of the prefabricated window stool/apron unit of the embodiment of FIG. 1.

FIG. 1 shows a prefabricated window stool/apron unit 10 mounted to a casement C of a window W. As shown in FIG. 3 through FIG. 6, the window stool/apron unit 10 comprises an essentially horizontal ledge member 12 and an essentially vertical skirt member 14.

Figure 2:
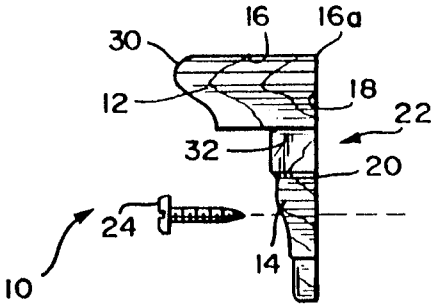
FIG. 2 right side view of the prefabricated window stool/apron unit of the embodiment of FIG. 1.
Figure 4:
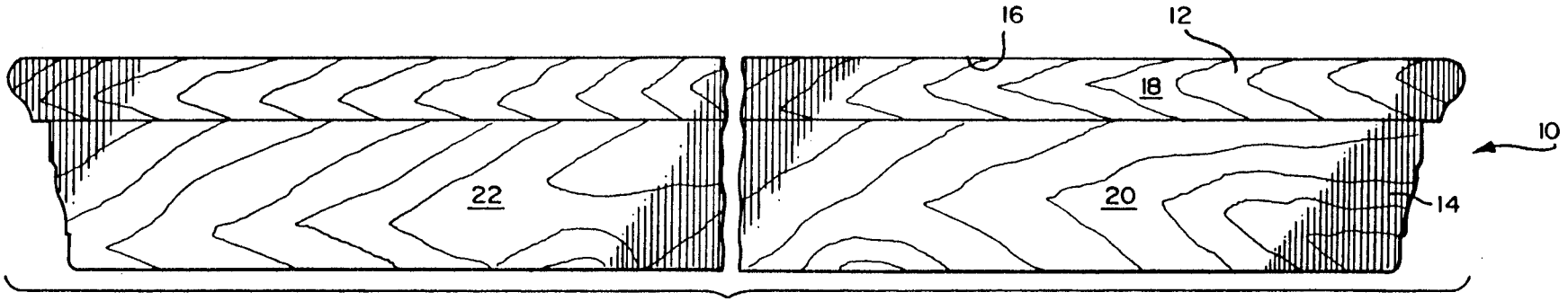
FIG. 4 is back view of the prefabricated window stool/apron unit of the embodiment of FIG. 1.
Figure 5:
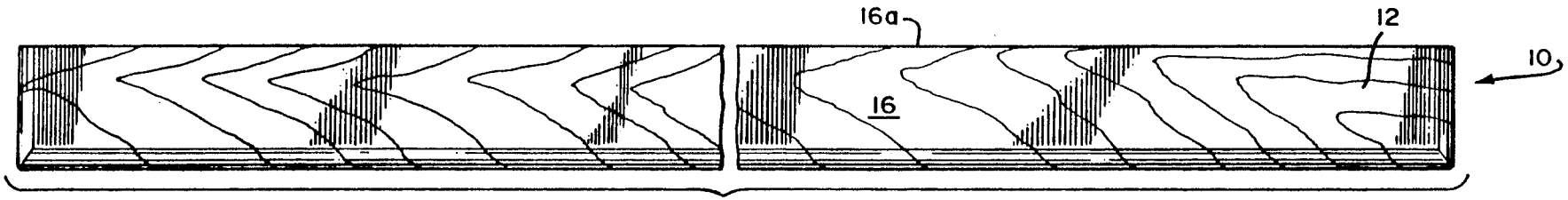
FIG. 5 is top view of the prefabricated window stool-/apron unit of the embodiment of FIG. 1.
Figure 6:
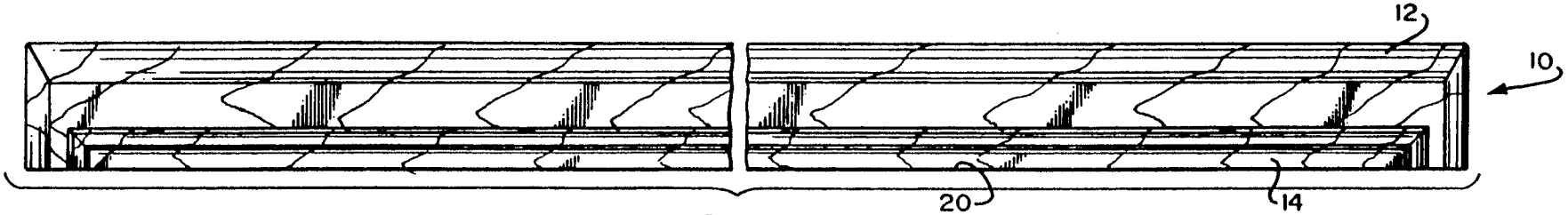
FIG. 6 is bottom view of the prefabricated window stool/apron unit of the embodiment of FIG. 1.

As seen in FIG. 2, the ledge member 12 has an essentially flat top horizontal surface 16 and an essentially flat back vertical surface 18. As shown in FIGS. 2 and 5, the top horizontal surface 16 has a back edge **16*a* which is coterminal with a top edge of the vertical surface 18. The top surface 16 and the back surface 18 of the ledge member 12 are essentially perpendicular with one another. The skirt member 14 has an essentially flat vertical back surface 20**.

The skirt member 14 is positioned beneath the ledge member 12 whereby the back surfaces 18, 20, respectively, of the ledge member 12 and skirt member 14 are essentially flush with one another to form a flat abutment surface 22.

Figure 7:
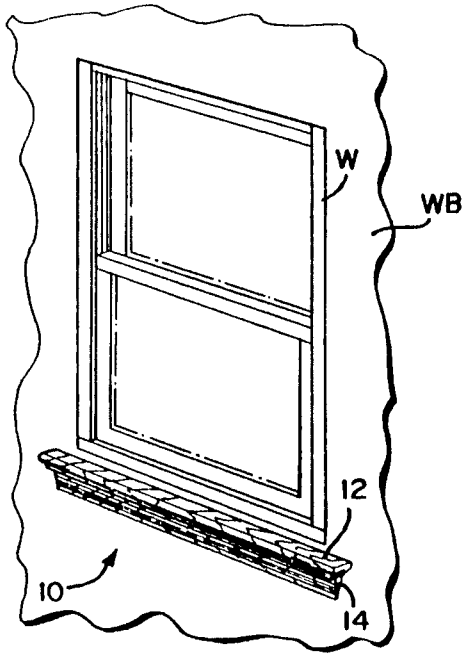
FIG. 7 is an isometric front view of a prefabricated window stool/apron unit according to an embodiment of the invention and further showing the manner of installation thereof to wallboard beneath a window.

The skirt member 14 is oriented to receive fasteners 24 which extend orthogonally through the skirt 14 with respect to the abutment surface and into either the window casement C (as in the case of FIG. 1) or into wallboard WB (as in the case of FIG. 7). The fasteners 24 may be threaded as shown, or instead may take the form of nails.

A vertical front surface 30 of the ledge member 12 and a vertical front surface 32 of the skirt member 14 are contoured with an appropriate design.

While the invention has been particularly shown and described with reference to the preferred embodiments thereof, it will be understood by those skilled in the art that various alterations in form and detail may be made therein without departing from the spirit and scope of the invention. For example, the length of the ledge and skirt members comprising the window stool/apron unit depends upon the type and size of window in connection with which the unit is to be employed.

The embodiments of the invention in which an exclusive property or privilege is claimed are defined as follows:

1. A prefabricated window stool/apron unit comprising:

a ledge member having a flat top horizontal surface and a flat planar back vertical surface; said back vertical surface being coterminal with top horizontal surface said of said ledge member;

a skirt member attached beneath the ledge member whereby the skirt member and the ledge member form a unit, the skirt member having a flat planar vertical back vertical surface, the skirt member being positioned beneath the ledge member whereby said flat planar back vertical surface of the ledge member and flat planar back initial surface of the skirt member are flush with one another to form a planar abutment surface.

2. The unit of claim 1, wherein the skirt member is oriented to receive fasteners which extend orthogonally with respect to the abutment surface .

3. The unit of claim 1, wherein the ledge member has a vertical front surface, and wherein the vertical front surface of the ledge member is contoured.

4. The unit of claim 1, wherein the skirt member has a vertical front surface, and wherein the vertical front surface of the skirt member is contoured.

* * * * *